US009569933B2

(12) United States Patent
Baker

(10) Patent No.: US 9,569,933 B2
(45) Date of Patent: Feb. 14, 2017

(54) METHOD AND APPARATUS FOR CONDUCTING AN ELECTRONIC CARD GAME TOURNAMENT

(71) Applicant: Brad Baker, Garland, TX (US)

(72) Inventor: Brad Baker, Garland, TX (US)

( * ) Notice: Subject to any disclaimer, the term of this patent is extended or adjusted under 35 U.S.C. 154(b) by 84 days.

(21) Appl. No.: 13/907,403

(22) Filed: May 31, 2013

(65) Prior Publication Data

US 2014/0357335 A1 Dec. 4, 2014

(51) Int. Cl.
*A63F 1/00* (2006.01)
*G07F 17/32* (2006.01)

(52) U.S. Cl.
CPC ..... *G07F 17/3293* (2013.01); *G07F 17/3218* (2013.01); *G07F 17/3223* (2013.01); *G07F 17/3241* (2013.01); *G07F 17/3276* (2013.01); *G07F 17/322* (2013.01)

(58) Field of Classification Search
CPC G07F 17/3218; G07F 17/322; G07F 17/3223; G07F 17/3225; G07F 17/3237; G07F 17/3276; G07F 17/3293; G07F 17/3241; A63F 13/30; A63F 13/31; A63F 13/32; A63F 13/33; A63F 13/70; A63F 13/71; A63F 13/73; A63F 13/79; A63F 2300/40; A63F 2300/403; A63F 2300/532; A63F 2300/5533; A63F 2300/5546; A63F 2300/5553
See application file for complete search history.

(56) References Cited

U.S. PATENT DOCUMENTS

2003/0109306 A1* 6/2003 Karmarkar ..... 463/40
2007/0213116 A1* 9/2007 Crawford et al. ..... 463/16
2008/0318651 A1* 12/2008 Gross et al. ..... 463/13

* cited by examiner

*Primary Examiner* — Damon Pierce
(74) *Attorney, Agent, or Firm* — Neal Massand

(57) ABSTRACT

Systems and methods for conducting a localized, electronic card game tournament adaptable for play in private homes and public venues with no equipment or system modifications are disclosed. In one embodiment the tournament players' identities are verified. Once the players identities are identified, they are provided with handheld electronic game units and tournament entry credentials. Players will enter their tournament entry credentials into the respective handheld electronic game units. Once the tournament entry credentials have been entered into the handheld electronic game unit, game events are transmitted to the handheld electronic game unit from a single remote server. Furthermore, in this embodiment, the tournament entry fee, if any, is maintained separately from the remote game server and the handheld electronic game units. The fees may be collected and/or winnings may be paid in case, through electronic transfer or through electronic currency.

11 Claims, 4 Drawing Sheets

METHOD AND APPARATUS FOR CONDUCTING AN ELECTRONIC CARD GAME TOURNAMENT

FIELD OF THE INVENTION

The present invention relates generally to conducting a localized, electronic card game tournament adaptable for play in private homes and public venues with no or limited equipment or system modifications.

BACKGROUND OF THE INVENTION

Gaming is an extremely popular form of entertainment. Games, particularly, games of chance and skill in which one or more players play and place wagers on the outcome thereof may be played in a variety of ways, including at a casino or other venue or on the Internet. Of the various forms of games which are available for play, many are played with playing cards. Of these, poker is arguably the most popular.

Traditionally, poker is played at a table with several players wagering paper, coin money or chips on a series of playing cards dealt from a deck of fifty-two cards. This deck is comprised of four suits at thirteen cards per suit. This form of poker requires a human dealer to coordinate the game, including dealing, wagering, folding, etc. One of the problems with traditional poker is that it suffers from the possibility of human/dealer error. In "social" card games, especially poker, the players take turns acting as the dealer, but in licensed commercial gaming establishments, such as casinos, the dealer is typically a non-playing employee. Thus, another problem associated with traditional poker games in this context is the training and retention of dealers. Additionally, another problem associated with traditional poker is that all players must physically sit at the same playing table, often for hours on end.

One alternative form of gaming, with particular reference to poker, flourished on the Internet. Internet gaming became quite successful in that it provided many choices for the players. In particular, Internet gaming was successful because it is fast and convenient, with registration, betting and payouts available from almost any computer with Internet access and with payments typically arranged via a pay service, such as PayPal.

One hallmark characteristic of internet poker is that players at disparate locations are assigned to virtual tables to play against each other. The game is administered by a remote server at yet another disparate location. As such, internet poker games flourished with players across the globe able to play against each other at virtually any time.

Video poker in casinos and other establishments has also become popular. In these games, players play against each other from specific locations where local game servers in conjunction with remote servers administer the electronic games. Video poker or other card games may also be provided by stand-alone machines similar to slot machines. These games typically occur at fixed locations and require installation of at least one local game server at the fixed location.

One major drawback of Internet and stand-alone type games is the lack of the human element. Many people prefer to play poker against other players, due in part to the drama associated with "live" gaming. An advantage of one embodiment of the invention is to incorporate the benefits of an electronic poker game without losing the advantages of live gaming.

Another major drawback is the difficulty in ensuring that playing games over the Internet complies with federal and state laws. By their nature, Internet games proliferate such that it is nearly impossible to ensure that players are located in specific locations or meet other criteria necessary to ensure legality of the games.

For example, the Unlawful Internet Gambling Act of 2006 (the "UIGA") was passed as a part of the Safe Accountability for Every Port Act of 2006 (the "SAFE Port Act"). The bill prohibits anyone engaged in the business of betting or wagering from accepting, in connection with unlawful Internet gambling, credit, an electronic fund transfer, a check or other payment drawn from a bank or any other financial transaction that involves a financial institution as the payor or intermediary. The statute defines unlawful Internet gambling as "to place, receive, or otherwise knowingly transmit a bet or wager by any means which involves the use, at least in part, of the Internet where such bet or wager is unlawful under any applicable Federal or State law." The effect of the UIGA has been to cause some organizations involved in i-gaming to stop accepting of bets originating in the United States.

In addition, eight states specifically regulate or prohibit i-gaming. Unlike China, the United States does not block or track Internet access. Without such restrictions on Internet access, it is all but impossible to regulate i-gaming by actually blocking an American from visiting certain websites. Thus, most state laws fit into the following four categories: laws against making bets, laws against taking bets, laws against financing of i-gambling wagers, and laws against advertising and promoting Internet gambling. The most common kinds of state regulation are laws against taking bets, and, to a lesser extent, laws against making bets primarily for technological reasons. Laws dealing with payment systems are almost exclusively federal because of the more complex nature of banking regulation and interstate commerce.

An additional drawback of video poker is that it requires rather extensive equipment set up. Typically, local game servers need to be installed in the venue where the games occur. Also video poker oftentimes requires electronic tables and/or other heavy equipment to be installed.

SUMMARY OF THE INVENTION

This invention relates to conducting a localized, electronic card game tournament adaptable for play in private homes and public venues with no equipment or system modifications. An object of the invention is to maintain many of the benefits of electronic card game tournaments, such as lower costs related to dealers, while avoiding many of the drawbacks related to electronic card game tournaments, such as difficulties in ensuring compliance with federal and state laws and high equipment costs.

In one embodiment, the invention incorporates conducting an electronic Texas Hold'Em poker tournament in a personal residence or other localized venue. The tournament is a series of games during which players are eliminated at each successive tournament level until a winner(s) is declared. As an initial step in this embodiment the tournament players register for the tournament and their identities are verified. This verification may be made through reviewing a players' governmentally issued identification card or by any other reliable means of verification. Registration may occur prior to identity verification or at the same time as identity verification. In this embodiment, it is also contemplated that players may be required to pay a tournament entry fee. It is further contemplated that an equipment rental fee may be collected. Furthermore, the fees may be collected or winnings may be paid through cash, electronic transfer, or electronic currency.

Once the players' identities are identified, they are provided with handheld electronic game units and tournament entry credentials. The handheld electronic game units are of limited functionality in that they may only be used for player authentication and game play.

In this embodiment, it is also contemplated that players will enter their tournament entry credentials into the respective handheld electronic game units. Once the tournament entry credentials have been entered into the handheld electronic game unit, the game begins at a specified time, and game events are transmitted to the handheld electronic game unit from a single remote server. In this way, in the electronic card game tournament of the invention, the need for a local game server to be installed at the residence or localized venue where the tournament occurs is eliminated.

Furthermore, in this embodiment, the tournament entry fee is maintained separately from the remote game server and the handheld electronic game units and any fees associated with the use of the remote game server and the handheld electronic game units. The tournament winnings, which may be distributed from the tournament entry fees, are distributed directly to the appropriate players. The entry fee and winnings may be collected and/or distributed electronically.

With respect to player authentication, various methods have been used to verify submitted passwords in a network setting. In one embodiment, cryptographic protection is used for player authentication. The most widely used cryptographic protection is the Transport Layer Security (TLS, previously called SSL) feature built into most current Internet browsers. Most browsers alert the user of a TLS/SSL protected exchange with a server by displaying a closed lock icon, or some other sign, when TLS is in use.

It is obvious that there are several differences in electronic poker and live poker played in a casino. Most of these differences are easily seen and transparent to the general poker playing public. However, many contrasts are not visible or apparent while playing electronic poker. The major variance between electronic poker and live poker is the cards and how they are delivered to the player.

In the Texas Hold'Em variant of electronic poker, each player is dealt, face-down, a hand consisting of two cards. After a betting round, the electronic "dealer" turns face-up three communal cards known as the "flop". After another betting round, the dealer turns face up one more communal card. Another betting round follows, after which the dealer turns base of the last of the five communal cards. After a final betting round, the winning players are determined by comparing the best five card hand each player can make using their own personal two card hand in conjunction with any three of the five communal cards, using poker rank as the criterion for comparison.

The mechanics of electronic Texas Hold'Em poker are well known to those of skill in the art. They are discussed at length in numerous references, including for example Braids, Sam; The Intelligent Guide to Texas Hold'Em Poker; Intelligent Games Publishing; 2003, Towson, Md. As described therein, there are an abundance of software programs exhibiting the basic features of putting on poker games as required by the preferred embodiment of the invention. The discussion of poker software included in Braids is incorporated by reference as if set forth herein.

Furthermore, electronic poker requires the use of a random number generator ("RNG") to create a shuffled deck. The best way to go about creating a shuffling algorithm is to develop a technique that can securely produce a well-shuffled deck of cards by relying on sound mathematics. It is important that the shuffling algorithm maintains an even distribution of cards. A good distribution ensures that each position in the shuffle has an approximately equal chance of holding any one particular card. The distribution requirement is relatively easy to achieve and verify. The following pseudo-code gives a simple card-shuffling algorithm that, when paired with the right random number generator, produces decks of cards with an even distribution.

```
START WITH FRESH DECK
GET RANDOM SEED
FOR CT=1, WHILE CT<=52, DO
X=RANDOM NUMBER BETWEEN CT AND 52 INCLUSIVE
SWAP DECK[CT] WITH DECK[X]
```

The RNG has a direct impact on whether the algorithm above will successfully produce decks of even distribution as well as whether these decks will be useful for secure electronic card play. To begin with, the RNG itself must produce an even distribution of random numbers. Pseudo-random number generators (PRNG), such as those based on the Lehmer algorithm, have been shown to possess this mathematical property. It is therefore sufficient to use a good PRNG to produce "random" numbers for card shuffling.

In yet another embodiment of the invention, after the winner of a hand has been determined all players who have participated in the pot above the blinds will have their hole cards exposed for a limited period of time before the next hand is dealt. Among other advantage, this unique feature of the invention deters "driving" and collusion between players.

Furthermore, in another embodiment of the invention, after a player is dealt his/her two hole cards face down, the handheld electronic gaming unit of the invention permits the player to view the cards face-up for a limited period of time. This unique feature aids players in preventing their hole cards from being revealed to other players.

In an additional embodiment of the invention, as the blinds are increased, players are "virtually relocated" in such a way as to deter collusion and fraudulent play.

These and other features and advantages will be apparent from the following brief description of the drawings, detailed description, and appended claims and drawings.

BRIEF DESCRIPTION OF THE DRAWINGS

Embodiments of the invention will now be described, by way of example, with reference to the accompanying drawings, wherein.

DETAILED DESCRIPTION OF THE DRAWINGS

The following description provides details with reference to the accompanying drawings. It should be understood that the invention may be embodied in many different forms and should not be construed as limited to the embodiments set forth herein. The system and method described herein may be implemented on an electronic gaming machine for use in a public venue or a private residence.

Figure 1:
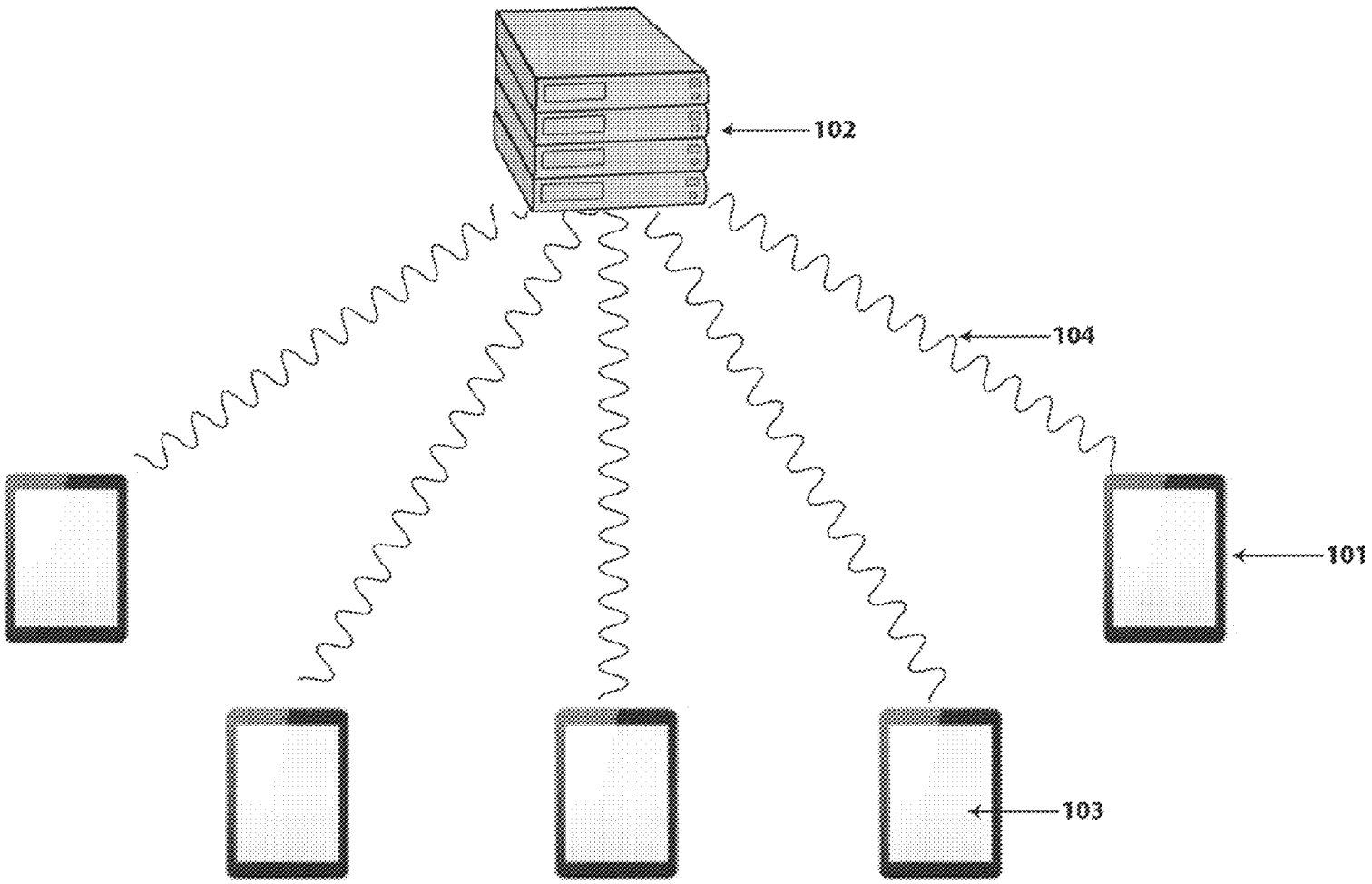
FIG. 1 illustrates a schematic description of a system for conducting a localized, electronic card game tournament of the invention.

FIG. 1 shows a group of handheld electronic game units 101 connected to a remote server 102. The game units pictured are capable of displaying electronic poker or other types of electronic card games. The server is capable of authenticating users and transmitting electronic game events to the game units. The use of the remote server 102 eliminates the need for localized servers in each venue as a single remote server 102 may be able to communicate with game units 101 at a number of venues. Although the remote server is discussed herein as a single server, those of skill in the art will recognize that a remote server may be composed of multiple hardware servers and software configurations.

Each game unit 101 has a number of components. A display 103 is used to show game play and resulting outcomes, and may be in the form of a video display. Touch screen displays are included on most game units and provide a flexible interface for operation, including displaying symbols during play All operational functions of the game units 101 are controlled by a controller such as a microprocessor (not shown) housed inside the unit 101. The controller executes instructions that include operation of a random number generator ("RNG") that is well known to those of ordinary skill in the art. Game outcomes are determined based on the results corresponding to the numbers selected by the RNG.

In the system of FIG. 1, game units 101 are connected to a server 102 that is used to interface with game units 101 to perform a number of different functions, depending on how games on game units 101 are configured to operate. Server 102 is in two-way communication with each of the game units 101 in a multi-device system over a network connection 104. Server 102 receives signals from the game units 101 that may indicate any of a number of different types of events occurring on the game units 101. Similarly, the RNG is run securely on the server based system and then delivers the outcomes to be displayed on the game units 101.

It will be understood that the type of network over which data is communicated can be one of several different types of networks. These networks include a Local Area Network (LAN), Wide Area Network (WAN), an intranet or the Internet. Other proprietary networks could also be used without departing from the principles of the invention.

Figure 2:
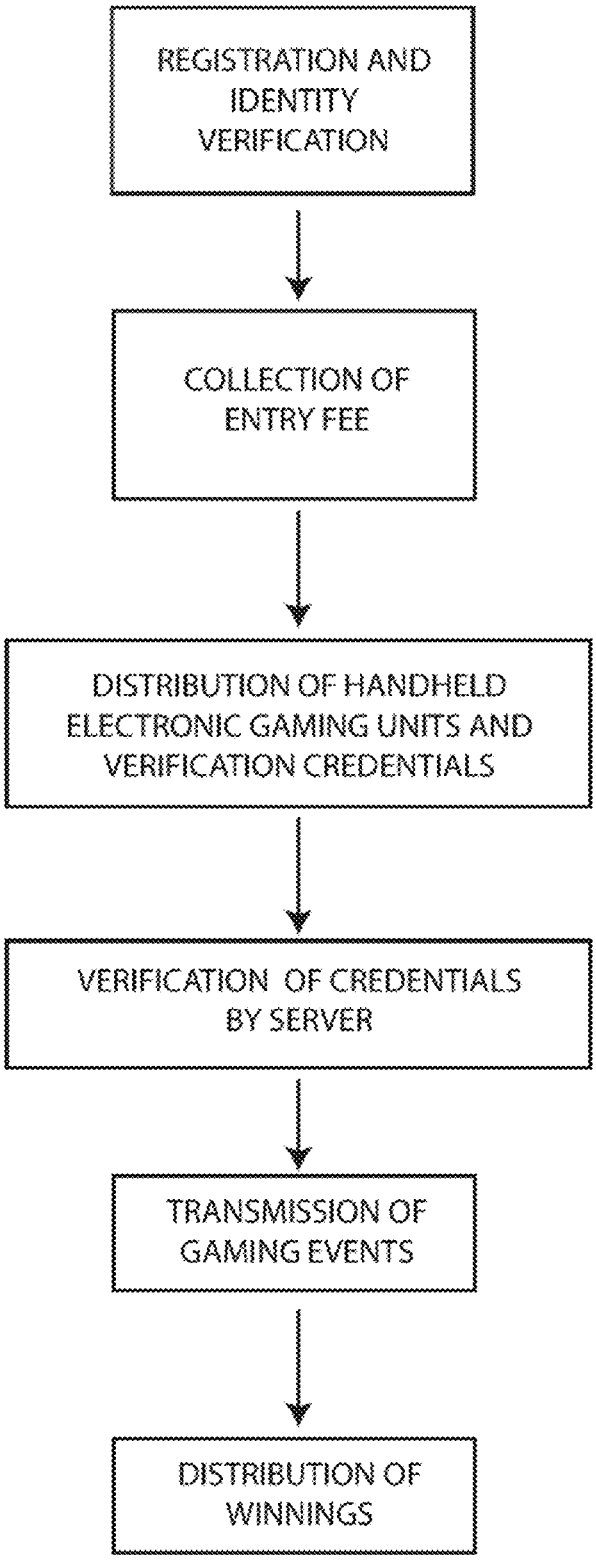
FIG. 2 is a flowchart showing the steps used in conducing conducting a localized, electronic card game tournament of the invention.

FIG. 2 is a flow chart depicting the method of conducting a localized, electronic card game tournament of the invention. In step 1, the tournament players register and their identities are verified. This verification may be made through reviewing a players' governmentally issued identification card or by any other reliable means of verification. In step 2 of this embodiment, players are required to pay a tournament entry fee. This fee is maintained separately from the electronic game system and any fees associated with the use of the electronic game system. In step 3, players are provided with handheld electronic gaming units and player verification credentials. In step 4, players enter their verification credentials into the handheld electronic gaming units and the credentials are transmitted to the server over the network. In step 5, at a specified start time, gaming events are transmitted over the network to the handheld electronic gaming units. In step 6, tournament winnings comprised of the tournament entry fees are distributed to the tournament winners.

Figure 3:
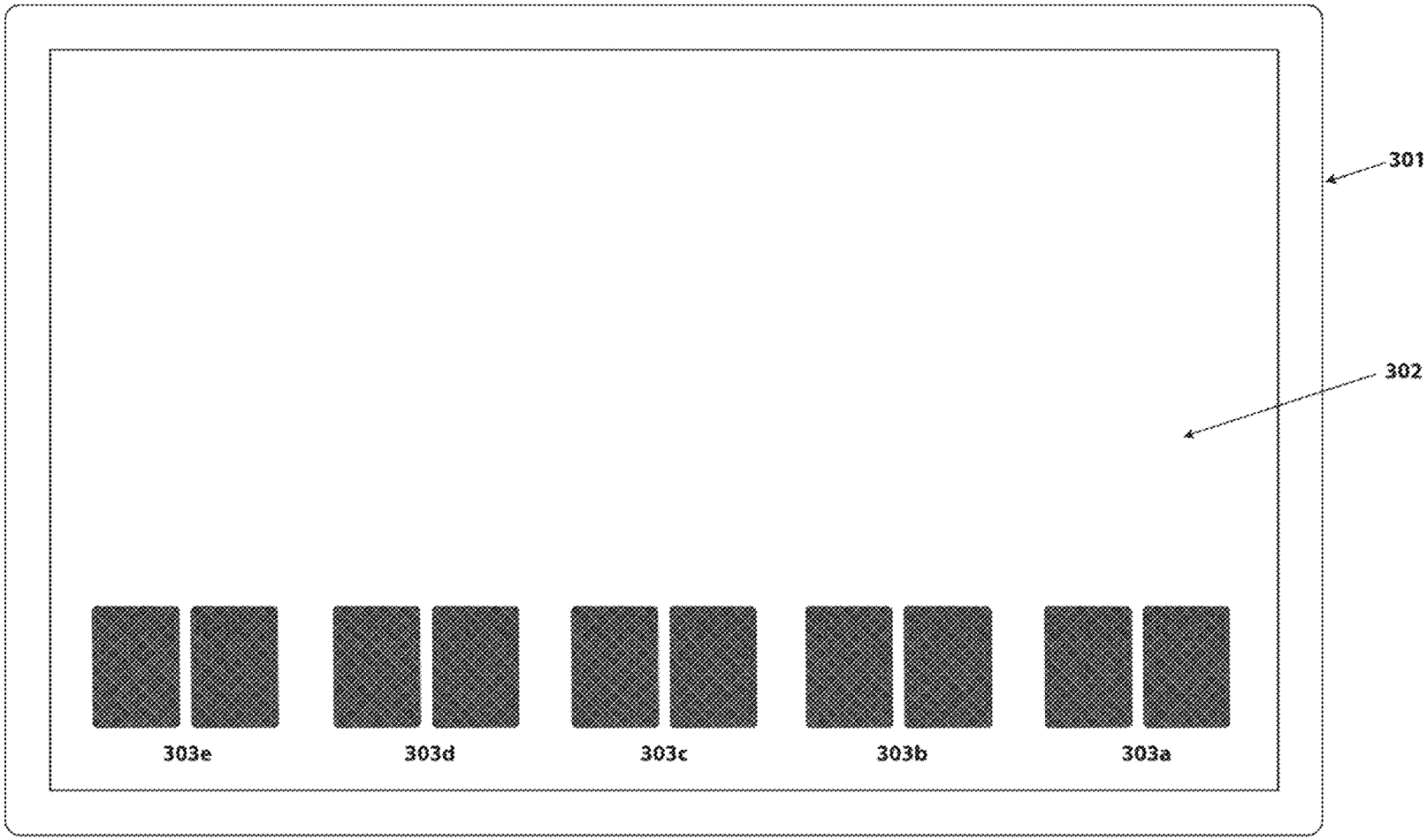
FIG. 3. shows electronic gaming machines for playing a game connected to a network controlled by a server.

FIG. 3 shows a handheld electronic gaming unit 301 for playing a localized, electronic poker tournament of the invention having a display screen 302 for displaying cards or other symbols at positions 303*a-e*. The display screen 302 may comprise a touchscreen that may be used by a player to provide input to handheld electronic gaming unit 301. Buttons may appear on the screen lined up under card positions 303*a-e* or otherwise proximate to card positions. A computer processor (not shown) and an internal memory (not shown) that stores an executable game program are among the internal circuit components that allow the handheld electronic gaming unit to operate an electronic poker game or other type of game. As generally discussed above with respect to FIG. 1, the internal components, configurations and operations of a handheld electronic gaming unit are well known to those of ordinary skill in the art.

Figure 3A:
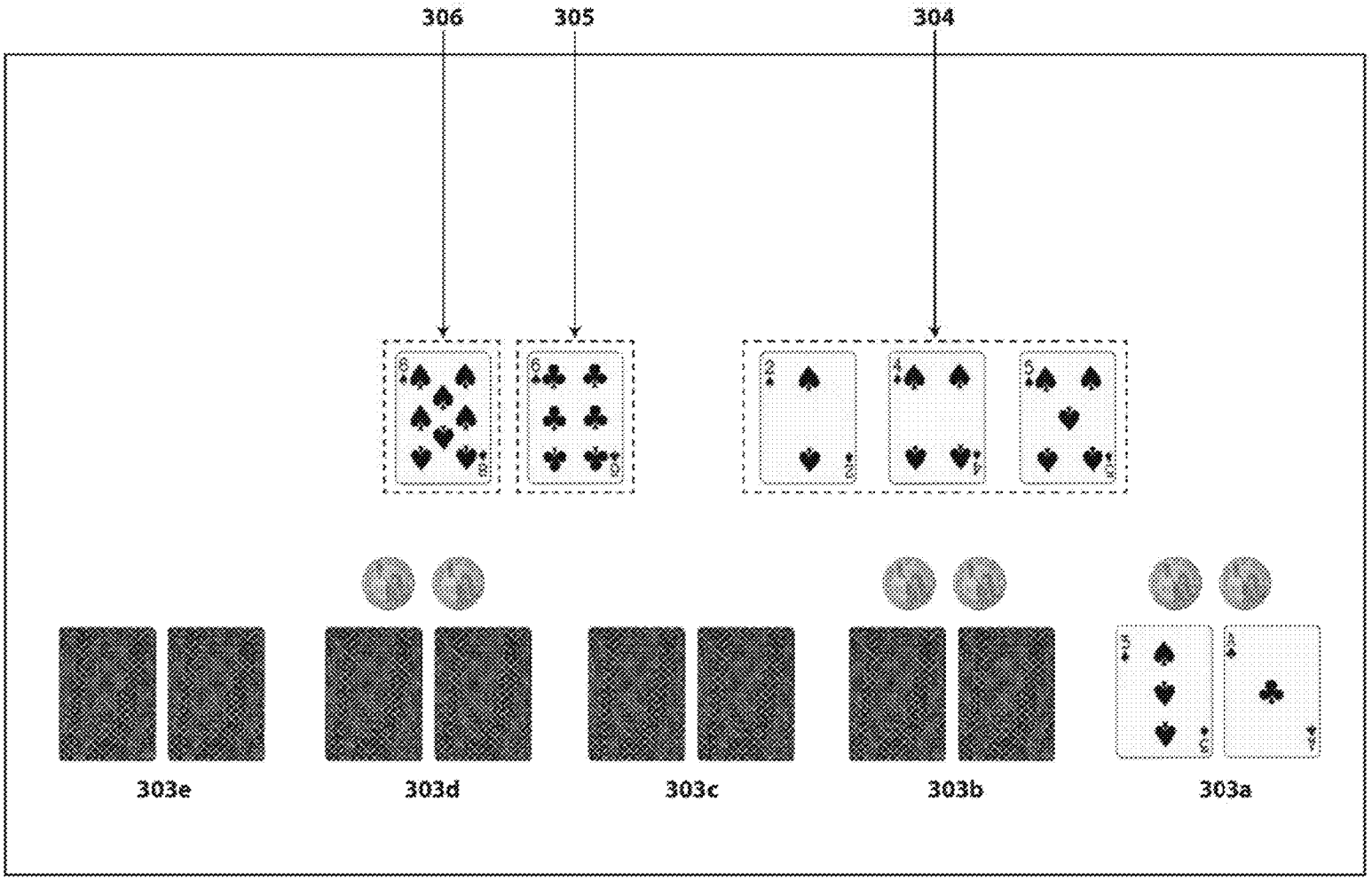

FIG. 3A is a screen shot of display screen 302 of gaming unit 301 after a player has initiated game play. As can be seen in FIG. 3A, the two players to the left of the dealer at positions 303*a* and 303*b* have put out blind bets. The screen shot shows the view of the player at location 303*a*. The player directly to the dealer's left 303*a* puts out the small blind while the player two to the dealer's left 303*b* puts out the big blind.

Every player at locations 303*a-e* is dealt two cards, face down. These are called hole or pocket cards. The cards at location 303*a* are displayed in the screen shot of this players' view when the "view cards" option has been activated.

The action, or the first move, falls on the player to the left of the big blind 303*c*. The player at this position can either call the bet, raise it, or fold. Betting continues around the table, clockwise. As shown in this figure, the player at location 303*d* has participated in the hand by calling the bet.

After the betting is completed, three cards are dealt face up in the center of the table 304, which is referred to as the board. The first three cards in Texas Hold'em are called the flop. These cards are "community cards" meaning everyone can (and will) use them in combination with their own hole cards to make the best hand.

From the flop on, betting begins with the player to the dealer's left 303*a*, who can check or bet.

A fourth card is dealt face up onto the board 305. This is called fourth street or the turn card. After this card is dealt, another round of betting occurs.

The final card is dealt face up 306. This card is also called fifth street or the river.

A final round of betting occurs. The remaining players show their cards and the person who can make the best five card hand by combining their pocket cards with the cards on the board wins. In some rare cases in Texas Hold'em, the five cards making up the board will actually be the best hand, in which case everyone left in the hand divides up the pot.

It is to be understood that the above descriptions and drawings are only for illustrating representative variations of the present invention and are not intended to limit the scope thereof. Any variation and derivation from the above description and drawings are included in the scope of the present invention.

What is claimed is:

1. A method of conducting a localized, electronic card game tournament comprising:

verifying identities of tournament players who are located at a specified venue via a player's governmentally issued identification card;

providing players with handheld electronic gaming units having a display screen, a processor, and an internal memory storing an executable game program; wherein said handheld electronic gaming units are connected to a single wireless local area network;

providing said players with authentication credentials;

authenticating said players' credentials via said handheld electronic gaming units and a remote game server;

said remote game server further comprising a random number generator;

sending gaming events from said remote game server to the handheld electronic gaming units via said wireless local area network;

wherein said gaming events include dealing cards and displaying bets including small and big blinds during a card game of poker via the executable game program stored in the handheld electronic gaming units; and wherein, as the blinds are increased, players' virtual positions are relocated on the display screen of the handheld electronic gaming unit in such a way as to deter collusion and fraudulent play.

2. The method of claim 1 wherein entry fees are collected from the tournament players.

3. The method of claim 2 wherein the entry fees are distributed to the winners of the tournament.

4. The method of claim 2 wherein the entry fees are maintained separately from the remote game server and the handheld electronic game units.

5. The method of claim 1 wherein the card game is Texas Hold'Em poker.

6. The method of claim 5 wherein, after a winner has been determined, cards of all said players who have placed a wager above a forced wager are exposed on a display of the handheld electronic gaming units for a limited period of time.

7. The method of claim 5 wherein the handheld electronic gaming unit changes the display of the player's hole cards from face-down to face-up in response to an input from the player.

8. A system for conducting an electronic poker tournament comprising:

handheld electronic gaming units located at a single specified venue connected to a remote game server over a single wireless local area network;

the handheld electronic gaming units operable to accept authentication credentials and transmit them to the remote game server over the wireless local area network;

the remote game server operable to transmit gaming events to the handheld electronic gaming units over the wireless local area network including small and big blinds during a card game of poker via an executable game program stored in the handheld electronic gaming units;

wherein, as the blinds are increased, players' virtual positions are randomly relocated in such a way as to deter collusion and fraudulent play the remote game server further comprising a random number generator;

the handheld electronic gaming units further operable to transmit inputs from tournament players over the wireless local area network.

9. The system of claim 8 wherein the card game is Texas Hold'Em poker.

10. The system of claim 9 wherein the, after a winner has been determined, cards of all said players who have placed a wager above a forced wager are exposed on a display of the handheld electronic gaming units for a limited period of time.

11. The system of claim 9 wherein the handheld electronic gaming unit changes a display of a player's hole cards from face-down to face-up in response to an input from the player.

* * * * *